US006708519B1

(12) United States Patent
Monk et al.

(10) Patent No.: US 6,708,519 B1
(45) Date of Patent: Mar. 23, 2004

(54) ACCUMULATOR WITH INTERNAL DESICCANT

(75) Inventors: David T. Monk, Bristol, VA (US); John K. Narney, II, Bristol, VA (US)

(73) Assignee: Bristol Compressors, Inc., Bristol, VA (US)

( * ) Notice: Subject to any disclaimer, the term of this patent is extended or adjusted under 35 U.S.C. 154(b) by 0 days.

(21) Appl. No.: 10/331,916

(22) Filed: Dec. 30, 2002

(51) Int. Cl.[7] ..... F25B 43/00; F25B 1/00
(52) U.S. Cl. ..... 62/503; 62/498
(58) Field of Search ..... 62/503, 498

(56) References Cited

U.S. PATENT DOCUMENTS

| | | | | |
|---|---|---|---|---|
| 1,677,804 A | | 7/1928 | Thayer | |
| 2,594,108 A | | 4/1952 | Woodbridge | |
| 3,175,342 A | | 3/1965 | Balogh | |
| 3,592,563 A | | 7/1971 | Glass et al. | |
| 3,905,201 A | | 9/1975 | Coveney et al. | |
| 4,053,398 A | | 10/1977 | Venema | |
| 4,174,204 A | * | 11/1979 | Chase | 55/283 |
| 4,406,593 A | * | 9/1983 | Kessler | 417/363 |
| 4,601,179 A | | 7/1986 | Johansson | |
| 4,607,503 A | * | 8/1986 | Fry | 62/503 |
| 4,685,941 A | | 8/1987 | Sato | |
| 4,888,962 A | * | 12/1989 | Harper et al. | 62/503 |
| 4,959,975 A | | 10/1990 | Harris | |
| 5,056,336 A | * | 10/1991 | Harrison | 62/498 |
| 5,177,982 A | * | 1/1993 | Plemens | 62/503 |
| 5,222,871 A | | 6/1993 | Meyer et al. | |
| 5,458,677 A | | 10/1995 | VanderMolen | |
| 5,507,159 A | * | 4/1996 | Cooksey | 62/503 |
| 5,562,427 A | | 10/1996 | Mangyo et al. | |
| 5,575,833 A | | 11/1996 | Griffin | |
| 6,074,177 A | | 6/2000 | Kobayashi et al. | |
| 6,092,284 A | * | 7/2000 | Dreiman et al. | 29/890.02 |
| 6,132,183 A | * | 10/2000 | Li et al. | 417/363 |
| 6,311,514 B1 | * | 11/2001 | Chisnell | 62/503 |

* cited by examiner

*Primary Examiner*—William C. Doerrler
*Assistant Examiner*—Filip Zec
(74) *Attorney, Agent, or Firm*—K. Scott O'Brian; Brian T. Sattizahn; McNees Wallace & Nurick LLC

(57) ABSTRACT

A compression device for use in a HVAC&R system that includes a compressor for compressing vaporized refrigerant having a compressor inlet and compressor outlet for directing compressed refrigerant downstream along a first conduit to a condenser. An accumulator is provided for preventing liquid refrigerant from reaching the compressor. The accumulator has an accumulator inlet for receiving refrigerant along a second conduit from an upstream evaporator and an accumulator outlet in fluid communication with the compressor inlet for receiving vaporized refrigerant therein. The accumulator and compressor are integrally connected thereto so that the accumulator and compressor may be installed into a refrigerant recycling system by connecting the compressor outlet with the first conduit and connecting the accumulator inlet with the second conduit. A desiccant is disposed inside the accumulator between the accumulator inlet and outlet for removing moisture from the refrigerant.

12 Claims, 2 Drawing Sheets

ACCUMULATOR WITH INTERNAL DESICCANT

BACKGROUND OF THE INVENTION

The present invention relates generally to an accumulator within a heating, ventilation, air-conditioning and refrigeration (HVAC&R) system, and more particularly to an accumulator that includes a desiccant and is integral with the compressor of the HVAC&R system.

Air-conditioning systems commonly employ an accumulator to ensure delivery of refrigerant in its vapor state to the compressor to avoid damaging the compressor. The accumulator delivers refrigerant vapor by typically employing a tube which extends from the upper portion of the accumulator to the lower portion, the tube further extending from the lower portion of the accumulator to a suction opening to the compressor. A mix of liquid and vapor refrigerant entering the top portion of the accumulator is directed around the opening in the tube for circulation within the body of the accumulator. Liquid refrigerant is separated from vapor refrigerant which is permitted to flow to the compressor, while the liquid refrigerant is collected and retained within the accumulator. In certain system configurations, the accumulator may be housed within the compressor shell.

To further enhance performance of an air-conditioning system, an in-line refrigerant filter may be employed to remove impurities from the refrigerant flow. The in-line filter is typically separately installed on the low pressure side of the system between the compressor and the evaporator. The installation of the filter requires a pair of brazed joints at opposed ends of the filter in order to secure the filter into the refrigeration lines of the system. In addition, the in-line filter can also include a desiccant to remove moisture from the refrigerant flow. Some examples of accumulators and/or filter arrangements can be found in U.S. Pat. Nos. 5,575,833 and 5,562,427 that are directed to an accumulator provided with a desiccant, and an accumulator housed within a compressor that is provided with a desiccant, respectively.

While systems formerly using refrigerants such as R-22 typically did not require inclusion of a desiccant filter to operate at near peak performance levels, systems using newer refrigerants such as R-410a often require the desiccant filter for proper operation of the system. Therefore, existing systems that are incorporating these newer, more environmentally friendly refrigerants will require the installation of a separate in-line desiccant filter for optimum performance. Further, it is common in the HVAC&R industry to replace any desiccant in the system at the same time as the compressor is replaced, which replacement process requires the installer to unbraze and braze four separate connections in the refrigerant line, two at the compressor and two at the drier.

Therefore, what is needed is an accumulator with a filter and desiccant that is integral with the compressor assembly that can simplify the replacement process and work efficiently with newer refrigerants.

SUMMARY OF THE INVENTION

The present invention is directed to a compression device for use in a HVAC&R system having a refrigerant flowing through the system. The compression device includes a compressor to compress refrigerant vapor having a compressor shell. The compressor has a compressor inlet to receive refrigerant vapor and a compressor outlet to transmit compressed refrigerant vapor from the compressor. An accumulator removes liquid refrigerant from the refrigerant flow and provides refrigerant vapor to the compressor. The accumulator has an accumulator inlet to receive refrigerant and an accumulator outlet in fluid communication with the compressor inlet to transmit refrigerant vapor to the compressor. The accumulator has a shell that is integral with the compressor shell to form a single casing assembly for the compression device. A desiccant is disposed inside the accumulator between the accumulator inlet and outlet for removing moisture from the refrigerant.

One advantage of the present invention is that it simplifies the installation process of a compressor and desiccant by eliminating the need for two brazed joints in the system.

A further advantage of the present invention is that by combining an accumulator with a desiccant, an inventory parts reduction may be realized in that a casing for the filter and/or desiccant is not required.

A still further advantage of the present invention is that the integrally combined compressor and accumulator/desiccant provide the advantages of space savings and moisture removal from the refrigerant without the cost associated with a system which employs a desiccant external to the compressor assembly.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
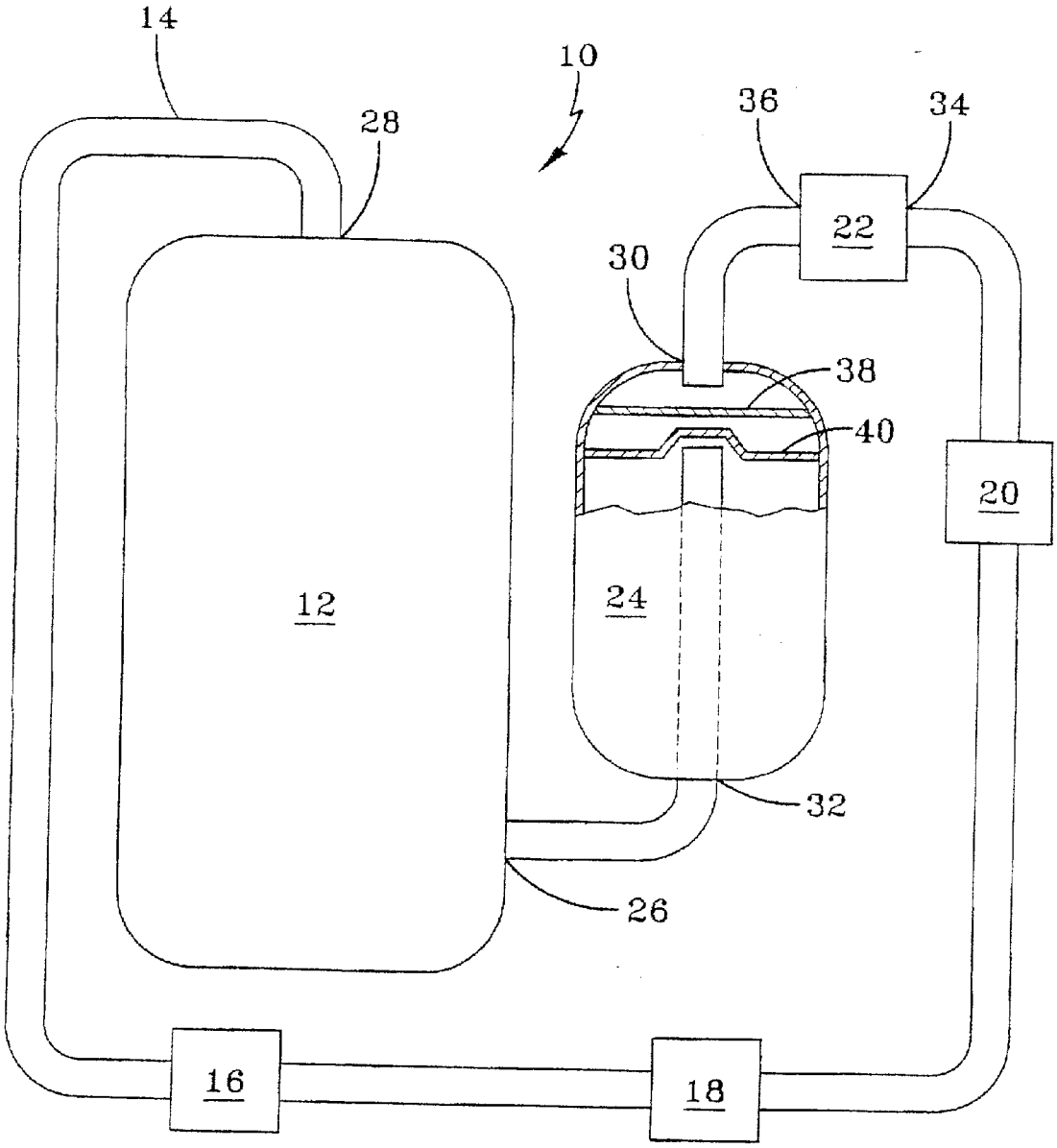
FIG-1 PRIOR ART
FIG. 1 is a schematic view of a prior art air-conditioning system.

FIG. 1 depicts a conventional air-conditioning system 10. A compressor 12 is connected to a power source (not shown) and compresses refrigerant vapor when energized by the power source. The substantially compressed fluid (compressed refrigerant vapor) is transferred or transmitted via a conduit 14, typically tubing, from compressor 12 to a condenser 16. In the condenser 16 the substantially compressed fluid enters into a heat exchange relationship with another fluid and at least partially undergoes a phase change to a high pressure liquid. The change of the fluid to a liquid is an exothermic transformation or event, causing the vaporous fluid to give up heat to the other fluid. The fluid is then transferred or transmitted from condenser 16 via conduit 14 to an expansion device 18. Expansion device 18 may include a valve or series of valves which causes the fluid to expand, resulting in the lowering of the pressure and temperature of the fluid. The fluid exits expansion device 18 via conduit 14 primarily as a cool low-pressure liquid, with possibly some vaporous fluid, and is transported to an evaporator 20. In evaporator 20, the substantially cool low-pressure liquid enters into a heat-exchange relation with yet another fluid and undergoes a phase change to be converted to substantially a gas. This phase change of the fluid from a liquid to a gas is an endothermic transformation which absorbs heat from the other fluid in contact with evaporator 20. The volume of fluid entering into contact with evaporator 20 is enhanced or increased by use of other devices such a blower (not shown). The gas exiting evaporator 20 may include some liquid that was not converted in evaporator 20. The fluid is then transferred via conduit 14 to a filtering device 22 that preferably employs a desiccant (not shown) to remove any water that may be present in the fluid. The refrigerant vapor, which may include liquid, from filtering device 22 is transported via conduit 14 to an accumulator 24. In accumulator 24, any liquid that is present in the refrigerant is removed and the liquid is stored until it vaporizes and is re-circulated back into the air-conditioning system 10. After the liquid is removed, the refrigerant vapor is drawn into the compressor to be compressed, and the cycle is repeated. The filter 22 is typically a separate unit, requiring installation within the air-conditioning system 10 by brazing inlet and outlet connections 34, 36.

Figure 2:
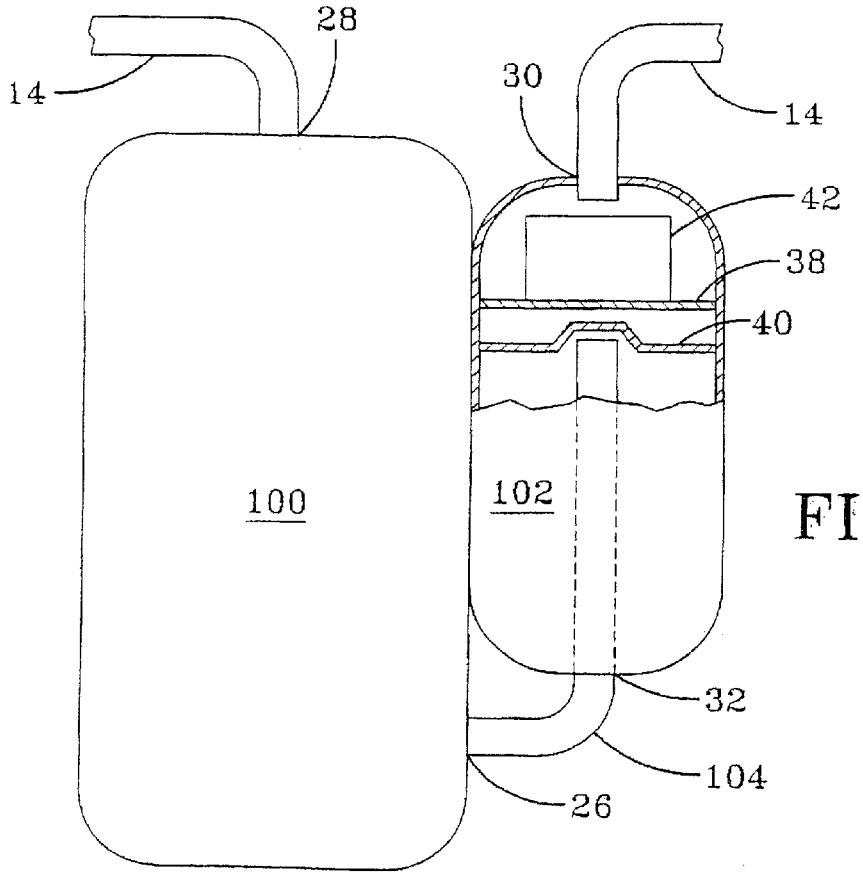
FIG. 2 is a schematic view of a HVAC&R system of the present invention.

In contrast, the present invention as illustrated in FIG. 2 incorporates a compressor 100 and an accumulator 102 into a HVAC&R system similar to the AC system 10 shown in FIG. 1. Compressor 100 is preferably a rotary or swing link compressor, however, any compressor that requires an accumulator and/or a desiccant can be used. Accumulator 102 is integrally connected or attached to the shell or casing of compressor 100. A conduit 104 extends inside of accumulator 102 and is installed between accumulator outlet 32 and compressor inlet 26, thereby providing a pre-installed connection between accumulator outlet 32 and compressor inlet 26. Although not shown, accumulator 102 and compressor 100 are connected or attached by a mechanical fastening means or device, including straps, bolts, screws, brackets, adhesives, welds or any conventional method of securing components together.

Accumulator 102 preferably employs a screen 38 and a baffle 40, each preferably adjacent accumulator inlet 30, to prevent particulate matter and liquid refrigerant from entering accumulator outlet 32 and traveling to compressor 100. A desiccant material 42 is placed between accumulator inlet 30 and screen 38 to remove any water that may be present in the refrigerant entering accumulator 102. Any accumulator configuration that can incorporate desiccant can be used. Any suitable desiccant material that is compatible with the refrigerant of the system can be used. By incorporating desiccant 42 and screen 38 within accumulator 102, there is no need for a separate filter, such as filter 22 from FIG. 1, thereby reducing the number of system components. Similarly, the number of brazed joints required to incorporate integrally connected compressor 100 and accumulator 102 is reduced to two, to compressor outlet 28 and accumulator inlet 30, since the brazed connections for filter inlet and outlet 34, 36 are no longer required.

Figure 3:
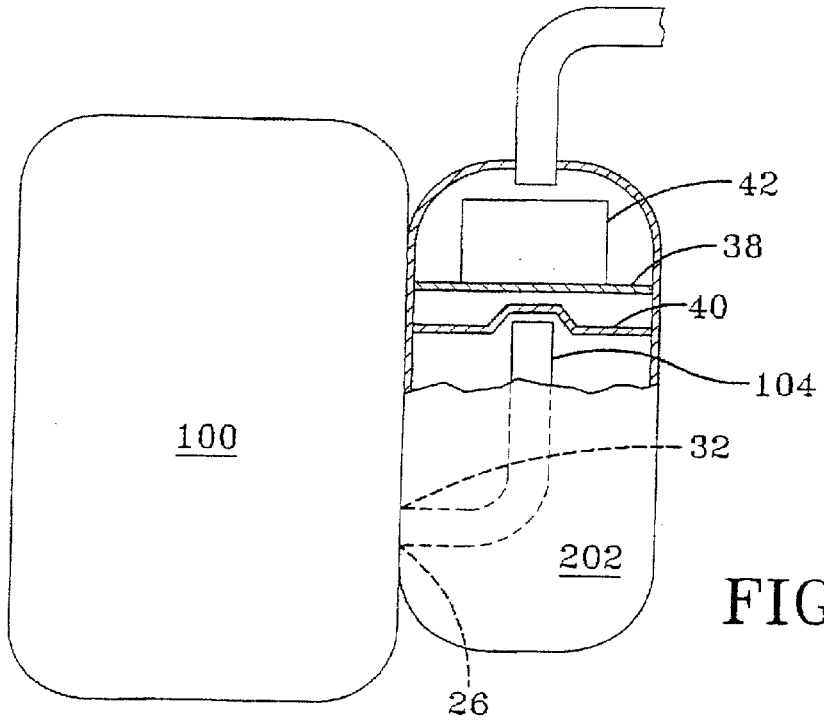
FIG. 3 is a schematic view of another embodiment of the HVAC&R system of the present invention.

Referring to FIG. 3, an alternate embodiment of the present invention is illustrated wherein conduit 104 is contained entirely within accumulator 202. In this construction, accumulator outlet 32 is integral with compressor inlet 26, thereby providing conduit 104 further protection from damage using the accumulator housing.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A compression device for use in a heating, ventilation, air-conditioning and refrigeration system having a refrigerant flowing through the system, the compression device comprising:

a compressor to compress refrigerant vapor having a compressor shell, the compressor having a compressor inlet to receive refrigerant vapor and a compressor outlet to transmit compressed refrigerant vapor from the compressor;

an accumulator to remove liquid from the refrigerant flow and provide refrigerant vapor to the compressor, the accumulator having an accumulator inlet to receive refrigerant and an accumulator outlet in fluid communication with the compressor inlet to transmit refrigerant vapor to the compressor, the accumulator having a shell that is integral with and in contact with the compressor shell to form a single unit for the compression device; and a desiccant disposed inside the accumulator between the accumulator inlet and outlet for removing moisture from the refrigerant.

2. The compression device of claim 1 wherein the compressor is of a rotary type.

3. The compression device of claim 1 wherein the compressor is of a swing link type.

4. The compression device of claim 1 wherein the accumulator outlet is integral with the compressor inlet.

5. A compression device for use in a heating, ventilation, air-conditioning and refrigeration system having a refrigerant flowing through the system, the compression device comprising:

a compressor to compress refrigerant vapor having a compressor shell, the compressor having a compressor inlet to receive refrigerant vapor and a compressor outlet to transmit compressed refrigerant vapor from the compressor;

an accumulator to remove liquid refrigerant from the refrigerant flow and provide refrigerant vapor to the compressor, the accumulator having an accumulator inlet to receive refrigerant and an accumulator outlet in fluid communication with the compressor inlet to transmit refrigerant vapor to the compressor, the accumulator having an outlet which is integral with the compressor inlet; the accumulator and the compressor being integrally combined, acting as a single unit; and a desiccant disposed inside the accumulator between the accumulator inlet and outlet for removing moisture from the refrigerant.

6. The compression device of claim 5 wherein the accumulator shell is integral with the compressor shell to form a single casing for the compression device.

7. The compression device of claim 1 further comprising a screen adjacent the accumulator inlet to prevent particulate matter from entering the accumulator outlet.

8. The compression device of claim 1 further comprising a baffle adjacent the accumulator inlet to prevent particulate matter from entering the accumulator outlet.

9. The compression device of claim 1 further comprising a screen and a baffle adjacent the accumulator inlet to prevent particulate matter from entering the accumulator outlet.

10. The compression device of claim 1 wherein the desiccant is disposed between the accumulator inlet and a screen to prevent particulate matter from entering the accumulator outlet.

11. A compression device for use in a heating, ventilation, air-conditioning and refrigeration system having a refrigerant flowing through the system, the compression device comprising:

a compressor to compress refrigerant vapor having a compressor shell, the compressor having a compressor inlet to receive refrigerant vapor and a compressor outlet to transmit compressed refrigerant vapor from the compressor;

an accumulator to remove liquid refrigerant from the refrigerant flow and provide refrigerant vapor to the compressor, the accumulator having an accumulator inlet to receive refrigerant and an accumulator outlet in fluid communication with the compressor inlet to transmit refrigerant vapor to the compressor, the accumulator having an outlet which forms an integral connection with the compressor inlet, the integral connection being disposed within the accumulators the accumulator and the compressor being integrally combined, acting as a single unit; and a desiccant disposed inside the accumulator between the accumulator inlet and outlet for removing moisture from the refrigerant.

12. The compressor device of claim 11 wherein the integral connection is a conduit.

* * * * *

UNITED STATES PATENT AND TRADEMARK OFFICE

CERTIFICATE OF CORRECTION

PATENT NO. : 6,708,519 B1 
DATED : March 23, 2004
INVENTOR(S) : David Turner Monk and John Kenneth Narney, II It is certified that error appears in the above-identified patent and that said Letters Patent is hereby corrected as shown below:

Column 6,
Line 6, "accumulators the accumulator" should be -- accumulator, the accumulator --.

Signed and Sealed this

Thirtieth Day of May, 2006

JON W. DUDAS
*Director of the United States Patent and Trademark Office*